US008339070B2

(12) United States Patent
Lai

(10) Patent No.: US 8,339,070 B2
(45) Date of Patent: Dec. 25, 2012

(54) LIGHT EMITTING DIODE LAMP

(75) Inventor: Chih-Ming Lai, Miao-Li Hsien (TW)

(73) Assignee: Foxsemicon Integrated Technology, Inc., Chu-Nan, Miao-Li Hsien (TW)

( * ) Notice: Subject to any disclaimer, the term of this patent is extended or adjusted under 35 U.S.C. 154(b) by 319 days.

(21) Appl. No.: 12/894,162

(22) Filed: Sep. 30, 2010

(65) Prior Publication Data

US 2012/0032597 A1 Feb. 9, 2012

(30) Foreign Application Priority Data

Aug. 3, 2010 (TW) ..... 99125670 A

(51) Int. Cl.
*H05B 41/36* (2006.01)

(52) U.S. Cl. ..... 315/311; 315/291; 315/224

(58) Field of Classification Search ..... 315/224, 315/185 R, 192, 291, 294, 297, 299, 300, 315/301, 302, 311, 312, 361, 177, 200 R
See application file for complete search history.

(56) References Cited

U.S. PATENT DOCUMENTS

| | | | | |
|---|---|---|---|---|
| 4,298,869 | A * | 11/1981 | Okuno | 345/82 |
| 6,149,283 | A * | 11/2000 | Conway et al. | 362/236 |
| 2004/0195983 | A1* | 10/2004 | Toyota et al. | 315/312 |
| 2006/0186827 | A1* | 8/2006 | Ragonesi et al. | 315/185 S |
| 2009/0009100 | A1* | 1/2009 | Rooymans | 315/246 |
| 2010/0072919 | A1* | 3/2010 | Wei et al. | 315/294 |
| 2010/0244713 | A1* | 9/2010 | Lee et al. | 315/192 |

* cited by examiner

*Primary Examiner* — Douglas W Owens
*Assistant Examiner* — Jianzi Chen
(74) *Attorney, Agent, or Firm* — Altis Law Group, Inc.

(57) ABSTRACT

An LED lamp includes first and second LED strings connected in parallel to each other and a variable resistor interconnected therebetween. The variable resistor includes a resistance track with resistance coils wound thereon and a slider moveable along the resistance track. One portion of resistance of the variable resistor is connected in series with the first LED string, and the other portion of the resistance of the variable resistor is connected in series with the second LED string. When a position of the slider of the variable resistor is changed, a first electric current flowing through one of the first and second strings is increased, while a second electric current flowing through the other one of the first and second strings is decreased, such that the color temperature of the LED lamp is changed accordingly.

17 Claims, 4 Drawing Sheets

LIGHT EMITTING DIODE LAMP

BACKGROUND

1. Technical Field

The present disclosure relates to an illumination device, and particularly to a light emitting diode (LED) lamp providing an adjustable color temperature.

2. Description of Related Art

At present, light emitting diodes (LEDs) are widely used due to high brightness, wide color gamut and rapid response speed. With the rapid development of decorative illuminations for both commercial and residential purposes, the demand for using LEDs in lamps for decorative illuminations is ever increasing.

It is important for the decorative illuminations to have a sufficient light energy in a correct color temperature since the color temperature affects the sensation of user's eyes. Thus, there is a need for a lamp which can emit light with an adjustable color temperature. However, the function of most conventional LED lamps for adjusting the color temperature is achieved by varying pulse width modulation (PWM) signals supplied thereto. Therefore, drive circuit for the LED lamps must include a PWM drive chip and many complicated peripheral circuits, which disadvantageously affects an illumination efficiency of the LED lamps and increases costs.

It is thus desirable to provide an LED lamp which can overcome the described limitations.

DETAILED DESCRIPTION

Figure 1:
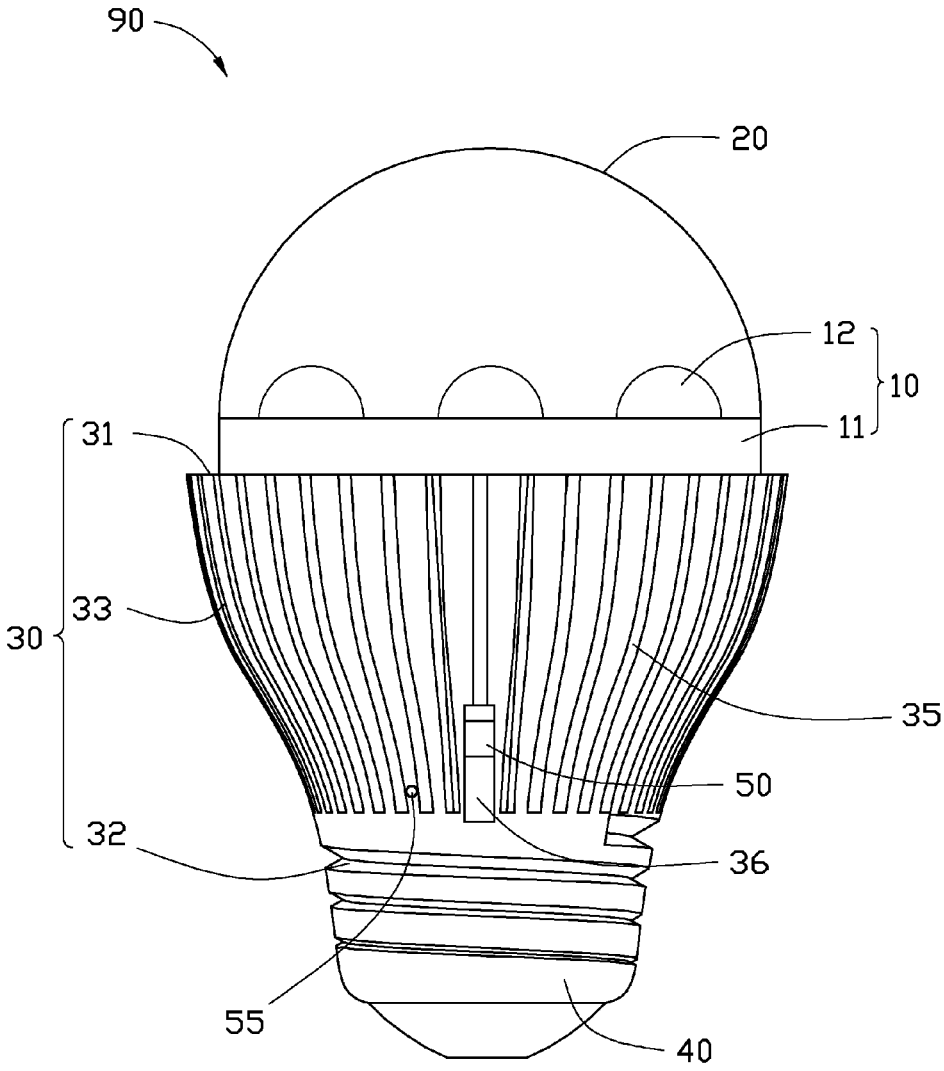
FIG. 1 is an elevational, assembled view of an LED lamp in accordance with an exemplary embodiment of the present disclosure.

Reference will now be made to the drawing figures to describe the present LED lamp in detail.

Referring to FIG. 1, an LED lamp 90 according to an exemplary embodiment of the present disclosure is shown. The LED lamp 90 includes an LED light source 10, an envelope 20 covering the LED light source 10 therein, a heat sink 30 thermally connected with the LED light source 10, a connecting head 40 electrically connected with the LED light source 10, and a first adjustment button 50 and a second adjustment button 55 at an outer surface of the heat sink 30.

Figure 2:
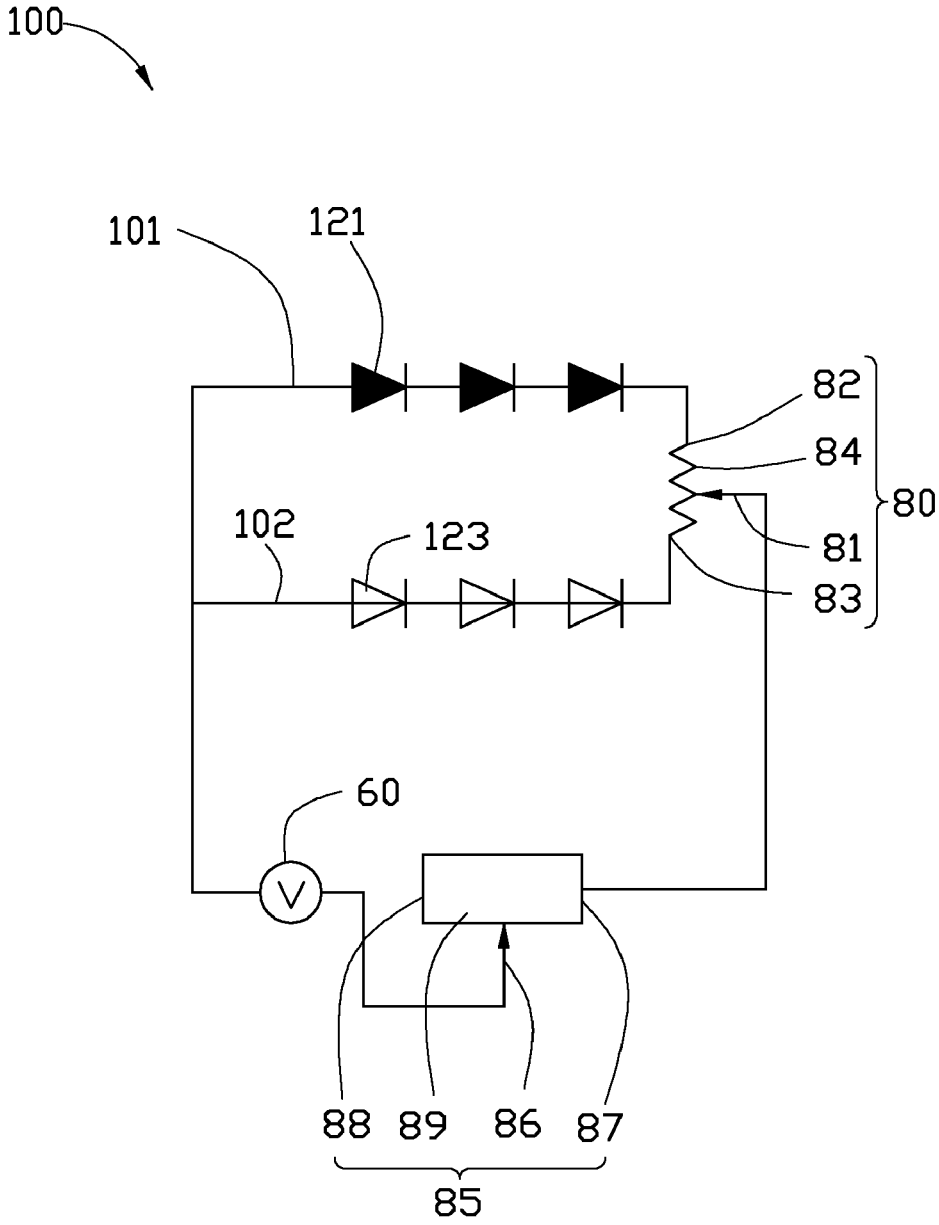
FIG. 2 is a schematic view of a circuit of the LED lamp in accordance with a first embodiment of the present disclosure.

The LED light source 10 includes a circular substrate 11 and a plurality of LEDs 12 mounted on the substrate 11. Referring to FIG. 2, the LEDs 12 include a plurality of first LEDs 121 connected in series with each other and providing a first color temperature and a plurality of second LEDs 123 connected in series with each other and providing a second color temperature different from the first color temperature. For providing a broad emission bandwidth, the first LEDs 121 emit cold color with the first color temperature of about 6500K, and the second LEDs 123 emit warm color with the second color temperature of about 2800K in this embodiment.

The envelope 20 is a hollow hemisphere shape, and defines an opening at a bottom side thereof. The envelope 20 connects a periphery edge of the substrate 11 to seal the opening, thereby defining a sealed receiving space therebetween for receiving the LED light source 10 therein.

The heat sink 30 is integrally made of a metal with good heat conductivity such as aluminum, copper or an alloy thereof. The heat sink 30 includes a circular top surface 31, a circular bottom surface 32 larger than the top surface 31 and a tapered side surface 33 interconnected between the top and bottom surfaces 31, 32. The LED light source 10 is mounted on the top surface 31. A plurality of axially grooves 35 is defined in the side surface 33 of the heat sink 30. The grooves 35 are equally spaced from each other along a circumference direction of the side surface 33 of the heat sink 30. The grooves 35 can increase an outer surface area of the heat sink 30, to thus promote a heat dissipation performance of the heat sink 30. An elongated cutout 36 is defined at a bottom portion of the side surface 33 of the heat sink 30.

The first adjustment button 50 is received in the elongated cutout 36. The first adjustment button 50 is slideable along the elongated cutout 36, to adjust a color temperature of the LED lamp 90. The second adjustment button 55 is located at one side of the first adjustment button 50. The second adjustment button 55 is rotatablely around a central axis thereof, to adjust an intensity of the LED lamp 90. Alternatively, the first adjustment button 50 can be a rotatable button like the second adjustment button 55; and the second adjustment button 55 can be a slideable button like the first adjustment button 50.

The connecting head 40 is electrically connected with the LED light source 10, and mounted on the bottom surface 32 of the heat sink 30. When used, the connecting head 40 of the LED lamp 90 electrically connects a direct current (DC) power source 60 (FIG. 2) or an alternating current (AC) power source 70 (FIGS. 3 and 4), such that the LED light source 10 can receive an electrical power from the DC power source 60 or the AC power source 70 to emit light.

Referring back to FIG. 2, a circuit 100 is shown which electrically connects the DC power source 60 with the first and second LEDs 121, 123 for working. The first LEDs 121 are connected in series to form a first LED string 101. The second LEDs 123 are connected in series to form a second LED string 102. Anodes of the first and second LED strings 101, 102 connect a positive pole of the DC power source 60. A first variable resistor 80 is connected between cathode of the first LED string 101 and cathode of the second LED string 102. A second variable resistor 85 is connected between the first variable resistor 80 and a negative pole of the DC power source 60.

Each of the first and second variable resistors 80, 85 includes a resistance track 84, 89 with resistance coil wound around thereon, first and second connecting posts 82, 83, 87, 88 at two opposite ends of the resistance track 84, 89, respectively, and a slider 81, 86 moveable along the resistance track 84, 89 to change a resistance between the slider 81, 86 and a corresponding connecting post 82, 83, 87. The first and second connecting posts 82, 83 of the first variable resistor 80 connect the cathode of the first LED string 101 and the cathode of the second LED string 102, respectively. The slider 81 of the first variable resistor 80 connects one of the connecting posts, i.e., the first connecting post 87 in this embodiment, of the second variable resistor 85. With this configuration, the resistance between the first connecting post 82 and the slider 81 of the first variable resistor 80 is connected in series with the first LED string 101, and the resistance between the second connecting post 83 and the slider 81 of the first variable resistor 80 is connected in series with the second LED string 102. The slider 86 of the second variable resistor 85 connects the negative pole of the DC power source 60. Thus, the resistance between the first connecting post 87 and the slider 86 of the second variable resistor 85 is connected in series between the LED light source 10 and the DC power source 60.

The slider 81 of the first variable resistor 80 is connected with the first adjustment button 50. When the first adjustment button 50 is moved upwardly along the elongated cutout 36, the slider 81 of the first variable resistor 80 follows the first adjustment button 50 to move along the resistance track 84 towards the first connecting post 82. Thus, the resistance connected in series with the first LED string 101 is decreased, and the resistance connected in series with the second LED string 102 is increased. Accordingly, a first electric current flowing through the first LED string 101 is increased, to thereby increase a light intensity of light emitted from the first LED string 101; simultaneously, a second electric current flowing through the second LED string 102 is decreased, to thereby decrease a light intensity of light emitted from the second LED string 102. Due to a light of the LED lamp 90 is a combination of the light of the first LED string 101 and the light of the second LED string 102, when the light intensity of the first LED string 101 is increased and the light intensity of the second LED string 102 is decreased, the color temperature of the LED lamp 90 is more closer to the color temperature of the first LED string 101, such that the color temperature of the LED lamp 90 is increased.

On the contrary, when the first adjustment button 50 is moved downwardly along the elongated cutout 36, the slider 81 of the first variable resistor 80 follows the first adjustment button 50 to move along the resistance track 84 towards the second connecting post 83. Thus, the resistance connected in series with the first LED string 101 is increased, and the resistance connected in series with the second LED string 102 is decreased. Accordingly, the first electric current flowing through the first LED string 101 is decreased, to thereby decrease the light intensity of the first LED string 101, and the second electric current flowing through the second LED string 102 is increased, to thereby increase the light intensity of the second LED string 102. When the light intensity of the second LED string 102 is increased and the light intensity of the first LED string 101 is decreased, the color temperature of the LED lamp 90 is much closer to the second LED string 102, such that the color temperature of the LED lamp 90 is decreased.

The slider 86 of the second variable resistor 85 is connected with the second adjustment button 55. When the second adjustment button 55 is rotated in a clockwise direction, the resistance between the first connecting post 87 and the slider 86 of the second variable resistor 85 is increased. Thus, a total electric current, which is equal to a sum of the first electric current and the second electric current, flowing through the LED light source 10 is decreased. Due to the second variable resistor 85 is connected in series with each of the first and second LED strings 1021, 102, both of the first electric current and the second electric current are decreased, thus a brightness of the LED lamp 90 is decreased. Contrarily, when the second adjustment button 55 is rotated in an anticlockwise direction, the resistance between the first connecting post 87 and the slider 86 of the second variable resistor 85 is decreased. Thus, both of the first and second electric currents are increased, and the brightness of the LED lamp 90 is increased.

In the present disclosure, the LED lamp 90 includes the first variable resistor 80 interconnected between the first and second LED strings 101, 102, with one portion of resistance of the variable resistor 80 connected in series with the first LED string 101 and the remaining portion of the resistance of the variable resistor 80 connected in series with the second LED string 102, such that when the portion of the resistance of the variable resistor 80 in connection with the first LED string 101 is increased (decreased) to decrease (increase) the first electric current flowing through the first LED string 101, the remaining portion of the resistance of the variable resistor 80 in connection with the second LED string 123 is decreased (increased) to increase (decrease) the second electric current flowing through the second LED string 102. Therefore, a ratio of light intensities of the first LED string 101 and the second LED string 102 is changeable, to thereby change the color temperature of the LED lamp 90. The circuit 100 is simple and includes only a few electronic components, which enables the LED lamp 90 to have a color temperature adjustable function with a low cost.

Figure 3:
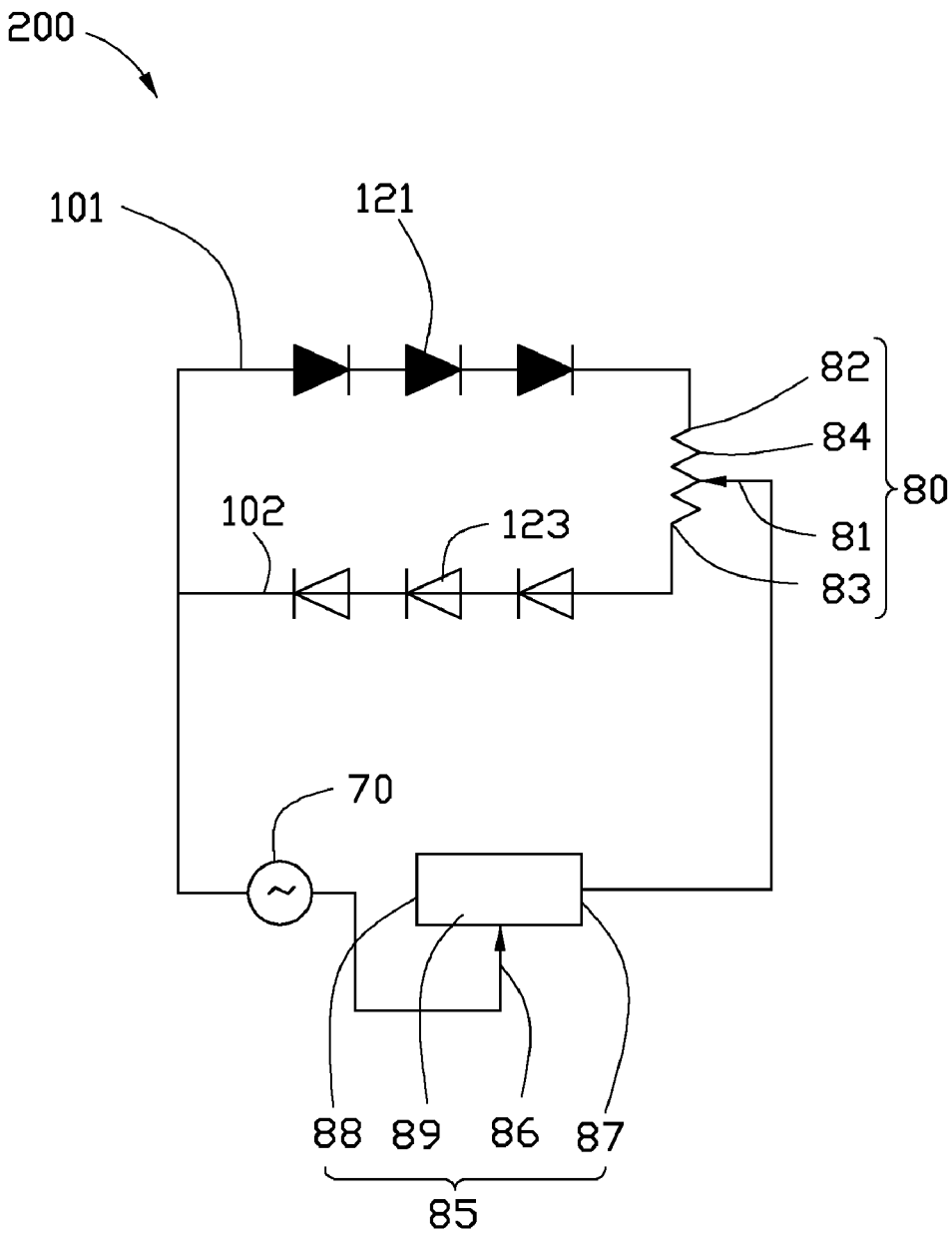
FIG. 3 is a schematic view of a circuit of the LED lamp in accordance with a second embodiment of the present disclosure.

Referring to FIG. 3, a circuit 200 which electrically connects the AC power source 70 with the first and second LEDs 121, 123 for working is shown, according to a second embodiment. The circuit 200 differs from the previous circuit 100 only in that the first and second LED strings 101, 102 are connected in parallel in opposite directions regarding the polarity. More specifically, the anode of the first LED string 101 connects the cathode of the second LED string 102, and the first variable resistor 80 is connected between the cathode of the first LED string 101 and the anode of the second LED string 102. In this embodiment, the color temperature and the brightness of the LED lamp 90 can be changed by changing positions of the sliders 81, 86 of the first and second variable resistor 80, 85 as the same way of the previous circuit 100.

Figure 4:
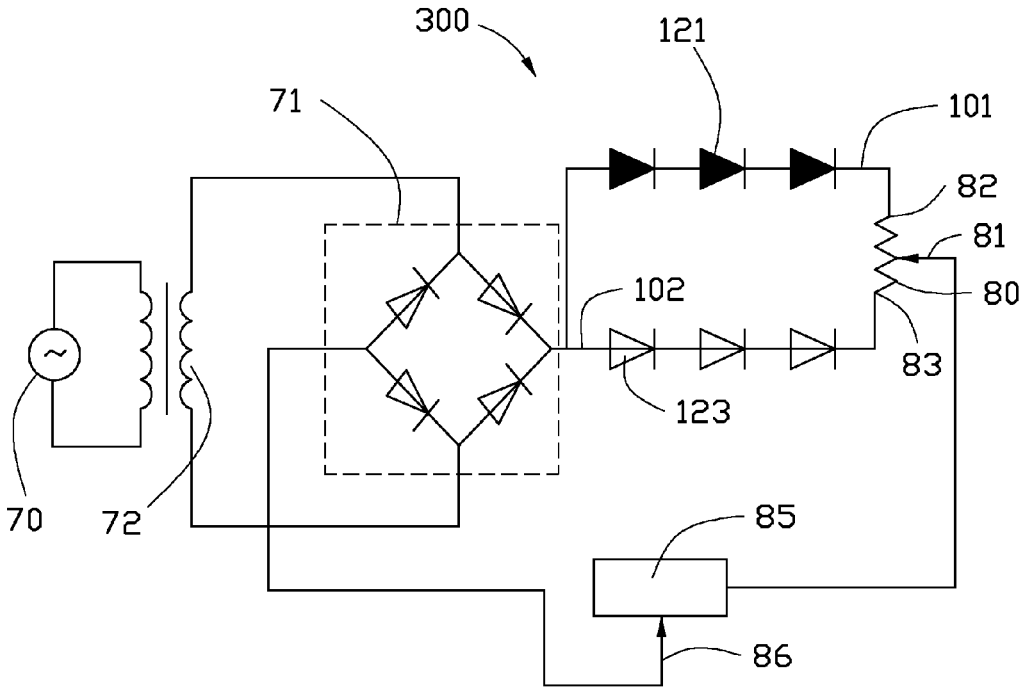
FIG. 4 is a schematic view of a circuit of the LED lamp in accordance with a third embodiment of the present disclosure.

Referring to FIG. 4, another circuit 300 is shown which electrically connects the AC power source 70 with the first and second LEDs 121, 123 for working according to a third embodiment. The circuit 300 differs from the previous circuit 100 only in that the first and second LED strings 101, 102 electrically connect the AC power source 70 via a transformer 72 and a bridge rectifier circuit 71. The transformer 72 converts electrical energy of the AC power source 70 to a predetermined AC voltage, and then the predetermined AC voltage can pass through the bridge rectifier circuit 71 to reach the first and second LED strings 121, 123. The bridge rectifier circuit 71 can connect with the first and second LED strings 101, 102, irrespective of the polarity of the first and second LED strings 101, 102. In this embodiment, the anodes of the first and second LED strings 101, 102 are connected with a first output terminal of the bridge rectifier circuit 71, while the cathodes of the first and second LED strings 101, 102 are connected with a second output terminal of the bridge rectifier circuit 71. Alternatively, the anodes of the first and second LED strings 101, 102 can connect the second output terminal of the bridge rectifier circuit 71, while the cathodes of the first and second LED strings 101, 102 can connect the first output terminal of the bridge rectifier circuit 71.

It is to be understood, however, that even though numerous characteristics and advantages of various embodiments have been set forth in the foregoing description, together with details of the structures and functions of the embodiments, the disclosure is illustrative only, and changes may be made in detail, especially in matters of shape, size, and arrangement of parts within the principles of the disclosure to the full extent indicated by the broad general meaning of the terms in which the appended claims are expressed.

What is claimed is:

1. An LED lamp, comprising:

a first LED string providing a first color temperature;

a second LED string connected in parallel with the first LED string, the second LED string providing a second color temperature difference from the first color temperature; and a variable resistor interconnected between the first LED string and the second LED string, the variable resistor comprising a resistance track with resistance coils wound thereon and a slider moveable along the resistance track, one portion of resistance of the variable resistor connected in series with the first LED string, and the other portion of the resistance of the variable resistor connected in series with the second LED string;

wherein when a position of the slider of the variable resistor is changed, a first electric current flowing through one of the first and second strings is increased, while a second electric current flowing through the other one of the first and second strings is decreased, such that the color temperature of the LED lamp is changed accordingly.

2. The LED lamp of claim 1, wherein anodes of the first and second LED strings connect a positive pole of a DC power source, two opposite ends of the resistance track is interconnected between cathodes of the first and second LED strings, and the slider of the variable resistor connects a negative pole of the DC power source.

3. The LED lamp of claim 2, further comprising another variable resistor interconnected between the slider of the variable resistor and the negative pole of the DC power source, the another variable resistor comprising a resistance track and a slider moveable along the resistance track of the another variable resistor, wherein when a position of the slider of the another variable resistor is changed, the first and second electrical currents are both increased or are both decreased.

4. The LED lamp of claim 3, wherein the first LED string comprises a plurality of first LEDs connected in series with each other, the first LEDs emitting light with cold color, the second LED string comprising a plurality of second LEDs connected in series with each other, the second LEDs emitting light with warm color.

5. The LED lamp of claim 1, wherein anode of the first LED string and cathode of the second LED string connect one end of an AC power source, the variable resistor is interconnected between cathode of the first LED string and anode of the second LED string, and the slider of the variable resistor connects another end of the AC power source.

6. The LED lamp of claim 5, further comprising another variable resistor interconnected between the slider of the variable resistor and the another end of the AC power source, the another variable resistor comprising a resistance track and a slider moveable along the resistance track of the another variable resistor, wherein when a position of the slider of the another variable resistor is changed, the first and second electrical currents are both increased or are both decreased.

7. The LED lamp of claim 6, wherein the first LED string comprises a plurality of first LEDs connected in series with each other, the first LEDs emitting light with cold color, the second LED string comprising a plurality of second LEDs connected in series with each other, the second LEDs emitting light with warm color.

8. The LED lamp of claim 1, wherein anodes of the first and second LED strings connect an output end of a bridge rectifier circuit, the variable resistor is interconnected between cathodes of the first and second LED strings, and the slider of the variable resistor connects another output end of the bridge rectifier circuit.

9. The LED lamp of claim 8, wherein further comprising another variable resistor interconnected between the slider of the variable resistor and the another output end of the bridge rectifier circuit, the another variable resistor comprising a resistance track and a slider moveable along the resistance track of the another variable resistor, wherein when a position of the slider of the another variable resistor is changed, the first and second electrical currents are both increased or are both decreased.

10. The LED lamp of claim 8, further comprising a transformer interconnected between the bridge rectifier circuit and an AC power source.

11. The LED lamp of claim 10, wherein the first LED string comprises a plurality of first LEDs connected in series with each other, the first LEDs emitting light with cold color, the second LED string comprising a plurality of second LEDs connected in series with each other, the second LEDs emitting light with warm color.

12. The LED lamp of claim 1, further comprising a heat sink thermally connecting the first and second LED strings, wherein an elongated cutout is defined in the heat sink with an adjustment button received therein, and the adjustment button is slideable along the elongated cutout to thereby change the position of the slider of the variable resistor.

13. The LED lamp of claim 12, wherein the heat sink comprises a circular top surface for supporting the first and second LED strings thereon, a circular bottom surface spaced from the top surface and a tapered side surface interconnected between the top and bottom surfaces, a plurality of axially grooves equally spaced from each other along a circumference direction thereof being defined in the side surface of the heat sink.

14. The LED lamp of claim 13, further comprising a connecting head mounted on the bottom surface of the heat sink, the connecting head electrically connecting with the first and second LED strings, the connecting head being configured to connect a power source for receiving electrical power therefrom.

15. An LED lamp, comprising:

an LED light source comprising a first LED string providing a first color temperature and a second LED string providing a second color temperature different from the first color temperature, the second LED string connected in parallel with the first LED string;

a variable resistor interconnected between the first LED string and the second LED string, the variable resistor comprising a resistance track with resistance coils wound thereon and a slider moveable along the resistance track, one portion of resistance of the variable resistor connected in series with the first LED string, and the other portion of the resistance of the variable resistor connected in series with the second LED string; and an adjustment button connected with the slider of the variable resistor to control a movement of the slider of the variable resistor;

wherein when a position of the slider of the variable resistor is changed, an electric current flowing through one of the first and second strings is increased, while an electric current flowing through the other one of the first and second strings is decreased, such that the color temperature of the LED lamp is changed accordingly.

16. The LED lamp of claim 15, further comprising a heat sink thermally connecting the first and second LED strings, wherein an elongated cutout is defined in the heat sink for receiving the adjustment button therein, and the adjustment button is slideable along the elongated cutout to thereby control the movement of the slider of the variable resistor.

17. The LED lamp of claim 16, further comprising another variable resistor interconnected between the slider of the variable resistor and a power source, and another adjustment button to control a movement of a slider of the another variable resistor, wherein when a position of the slider of the another variable resistor is changed, the electrical current flowing through the first LED string and the electrical current flowing through the second LED string are both increased or are both decreased.

* * * * *